United States Patent [19]

Blau

[11] 4,439,939

[45] Apr. 3, 1984

[54] SNOW PLOW

[76] Inventor: James R. Blau, 13220 W. Burlawn Ct., Brookfield, Wis. 53003

[21] Appl. No.: 21,220

[22] Filed: Mar. 16, 1979

Related U.S. Application Data

[63] Continuation-in-part of Ser. No. 884,690, Mar. 8, 1978, Pat. No. 4,187,624.

[51] Int. Cl.[3] ..... E01H 5/06

[52] U.S. Cl. ..... 37/231; 37/234; 37/235; 37/236; 37/266

[58] Field of Search ..... 37/42 R, 42 UL, 44, 37/46, 47, 50, 41, 231, 266, 234, 235, 236; 172/276, 801, 803, 804, 805, 806, 807, 809, 277

[56] References Cited

U.S. PATENT DOCUMENTS

| | | | |
|---|---|---|---|
| 1,977,817 | 10/1934 | Bird | 172/802 |
| 2,446,136 | 7/1948 | Jarmin | 172/809 |
| 2,740,213 | 4/1956 | Barrett | 172/809 |
| 2,867,921 | 1/1959 | Brown | 37/42 R |
| 3,165,842 | 1/1965 | Holopainen | 37/42 R |
| 3,201,878 | 8/1965 | Markwardt | 37/42 R |
| 3,307,275 | 3/1967 | Simi | 37/42 R |
| 3,432,946 | 3/1969 | Peitl | 172/801 X |
| 3,524,269 | 8/1970 | Jackoboice | 37/42 R |
| 3,585,319 | 6/1971 | Paverle | 37/42 R X |
| 3,706,144 | 12/1972 | Miceli | 37/42 R |
| 3,828,449 | 8/1974 | Miceli | 37/41 |

FOREIGN PATENT DOCUMENTS

| | | | |
|---|---|---|---|
| 594390 | 7/1959 | Italy | 37/42 R |
| 128695 | 6/1950 | Sweden | 37/42 R |
| 129656 | 10/1950 | Sweden | 37/42 R |
| 471288 | 5/1969 | Switzerland | 37/42 R |

*Primary Examiner*—Steven A. Bratlie

[57] ABSTRACT

A snow plow especially suitable for use with small vehicles, such as cars, is disclosed. The snow plow features a hydraulic system for controlling movement of the plow from side to side as well as for elevating the plow. The snow plow of the present invention also includes a coupling system which permits the plow to be quickly coupled to the vehicle for snow plowing and quick removal of the plow when the vehicle is to be used for its conventional purposes. The hydraulic system may be mounted either on the plow support frame or to the subframe assembly which is attached to the underside of the car.

1 Claim, 5 Drawing Figures

SNOW PLOW

RELATED APPLICATIONS

This application is a continuation-in-part of Application Ser. No. 884,690, filed on Mar. 8, 1978, entitled "Snow Plow" now U.S. Pat. No. 4,187,624.

FIELD OF THE INVENTION

The present invention relates generally to the art of snow plows and more particularly to snow plows of the type which are suitable for use with small vehicles, such as cars.

BACKGROUND OF THE INVENTION

Many different types of snow plows are known to the art. Conventional plows include a blade and a frame for coupling the blade to the front of a vehicle. More sophisticated plows also include means for adjusting the angular orientation of the plow blade relative to the longitudinal axis of the vehicle for elevating the plow blade relative to the road surface to permit the vehicle to be driven from one location to another.

Prior art snow plows are also known for use with many different sizes of vehicles. For example, plows are known which can be used with very large vehicles. These plows are typically used for large snow removal jobs such as airport runway clearing and the like. Smaller plows are known which can be coupled to dump or garbage trucks for use in road clearing operations, and still smaller snow plows are known which may be coupled to yet smaller trucks for use in driveway or parking lot clearing and the like. A typical example of the latter would be the type of plow frequently employed by the owner of a gasoline station for use with his tow or pick-up truck. Following a snowfall, such a plow would be coupled to the front end of the tow truck for use in clearing the station as well as for other snow clearing jobs in the neighborhood.

The type of plow just referred to is usually quite expensive, requires considerable time to attach to a vehicle, and includes structural features which makes them impractical for use with cars. For example, such plows commonly include a hydraulic pump assembly mounted externally on the vehicle, a feature which increases the exposure of the operating components to adverse weather conditions and increases the likelihood of theft or vandalism of the equipment. Moreover, such plows also include a bulky, viewobstructing plow lifting system mounted immediately adjacent the front end of the vehicle which includes a hydraulic cylinder oriented upwardly to engage a lifting arm which in turn is coupled to the plow by a chain. Extension of the cylinder causes the arm to be elevated which causes the chain to lift the plow blade above the road surface. This type of lift system, both because of its bulk and because of its tendency to shift weight off the back wheels of the vehicle, make this type of plow unsuitable for smaller vehicles such as cars. Typical examples of this type of plow are described in Simi's U.S. Pat. No. 3,307,275, issued Mar. 7, 1967, for "Vehicle Accessory Unit and Power Unit Therefore," and in Micelli's U.S. Pat. No. 3,706,144 issued Dec. 19, 1972, for "Control Means for a Snowplow."

Another related type of snow plow is described in Jackoboice's U.S. Pat. No. 3,524,269, issued Aug. 18, 1970, for "Mounting Means for Vehicular Implements." This device is different from that described above in that instead of using a vertical frame and upwardly directed hydraulic cylinder for raising the plow, it employs a horizontal cylinder which rotates a round member mounted to the plow blade frame to lift the plow. The vehicle's bumber supports one end of a lifting chain. The other end of the chain is attached to the round member and is wound therearound at the discretion of the driver to cause shortening of the chain length and resultant lifting of the blade. While the lifting mechanism is different, this type of plow still suffers from the same disadvantages as those discussed above which significantly impair the adaptability of this type of plow for use with small vehicles, such as cars.

Yet another type of lifting system for plow blades and the like is illustrated in Holopainen's U.S. Pat. No 3,165,842, issued Jan. 19, 1965, for "Mechanism for Attaching Implements to Vehicles." In the described device a link is located intermediate the subframe assembly and the implement and a cylinder acts on the link to rotate it and push the implement upward.

None of the aforementioned systems are entirely satisfactory for use with small vehicles, such as cars. This special utility requires ease of attachment, a lift system which will not obstruct the driver's view and a blade lift system which does not cause detrimental weight distribution problems or alter the vehicle's normal driving characteristics. The development of a snow plow assembly which would satisfy these objects and overcome the difficulties of the prior art would be a significant advance in this technology. Moreover, the provision of a snow plow assembly which permits flexibility in the selection of a suitable location for mounting the hydraulic components would be a further advance in this technology.

OBJECTS OF THE INVENTION

It is the primary object of the present invention to provide a snow plow assembly which can be used on a variety of sizes of vehicles, including fuel-efficient small cars.

Another object of the present invention is to provide a snow plow assembly, the hydraulic components of which can be mounted in the vehicle's engine compartment, on the plow support assembly or on the subframe assembly used to couple the plow to the vehicle.

Still another object of the present invention is to provide a snow plow assembly which can be quickly coupled to or uncoupled from a vehicle.

How these and other objects of the invention are accomplished will be described in the following specification, taken together with the FIGURES. Generally, however, they are accomplished by providing a vehicle subframe assembly coupled to the chassis of a vehicle, such as a car. A generally triangular plow support frame assembly is coupled to the subframe assembly by two pins. The plow frame support assembly includes a plow blade at its forward end as well as three hydraulic cylinders, two of which are for horizontally varying the angular orientation of the blade with respect to the longitudinal axis of the vehicle, and the third one of which is provided for lifting the plow blade with respect to the road surface. Each of the cylinders are coupled to a hydraulic system, the major components of which may be located within the engine compartment of the vehicle, on the plow assembly or on the subframe. Quick connections are preferably made near the vehicle's front bumper and the controls for the cylinders are mounted in the vehicle at or near the dash board.

DESCRIPTION OF THE PREFERRED EMBODIMENT

Figure 1:
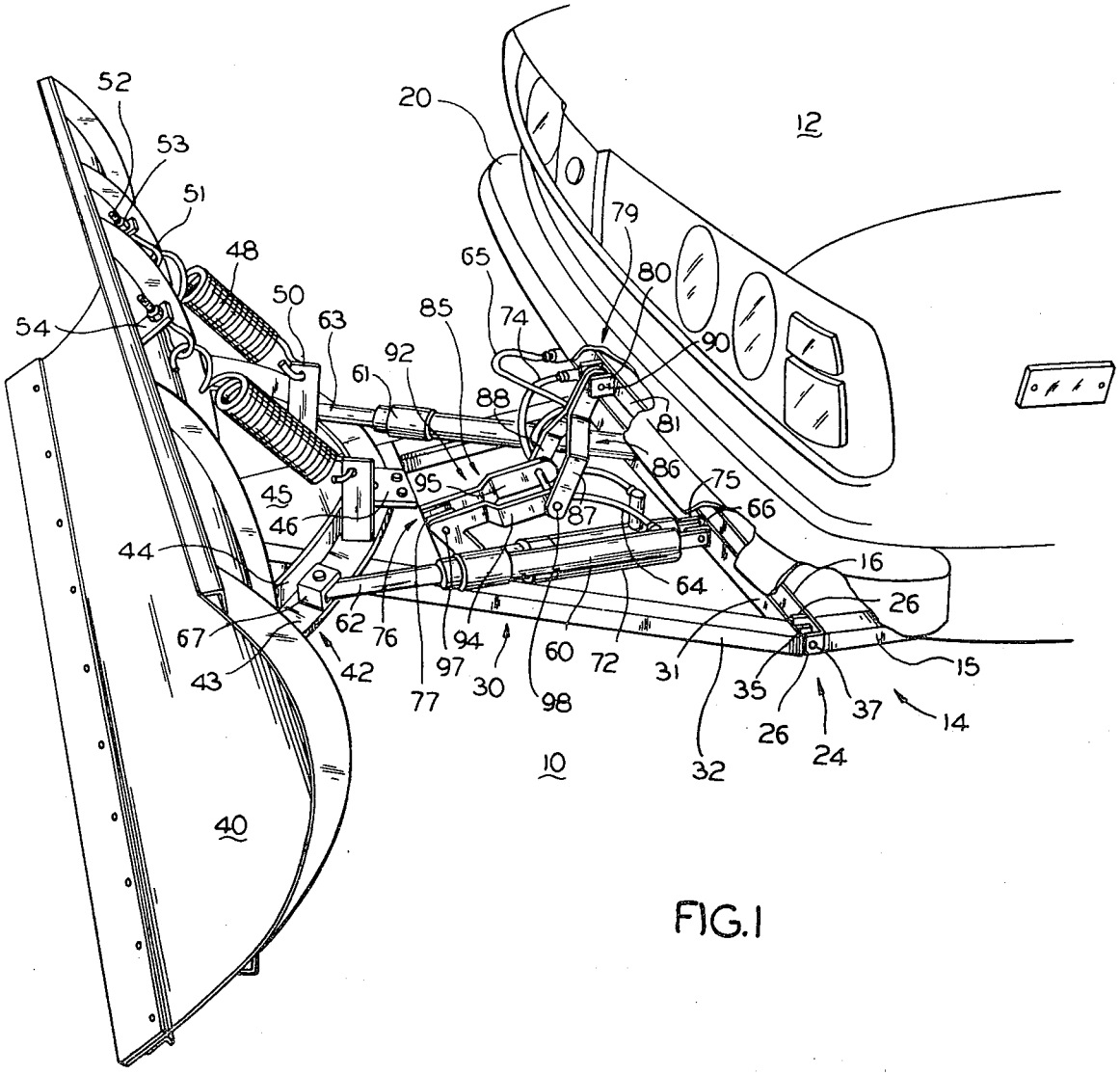
FIG. 1 is a perspective view of the snow plow assembly according to one preferred embodiment of the present invention.

FIG. 1 is a perspective view of a snow plow assembly 10 according to one embodiment of the present invention. Assembly 10, as illustrated, is coupled to the front end of a car 12, but the invention is not limited for use with cars. While it is true that the snow plow of the present invention is especially useful for smaller, fuel-efficient vehicles with which other commercially available plows are not suitable, assembly 10 could be readily adapted for use with jeeps, recreational vehicles, pick-up trucks, tow trucks and other types of trucks. Moreover, the system could be used with other vehicles such as tractors, bulldozers and the like.

A coupling frame 14 is also shown in FIG. 1, frame 14 including two side bars 15, and a front connecting member 16. Side bars 15 are parallel to one another and are preferably made of angle steel and extend from an area generally below the front bumper 20 of vehicle 12, along the bottom of the vehicle chassis just inside the wheel to an area typically near the vehicle's transmission mount (not shown). The side members 15 are bolted or otherwise securely fastened to the chassis and preferably to the front holddown brackets, but the details thereof are not provided because the particular configuration of side bars 15 will depend on the type of car 12 with which they are to be used. It should be mentioned, however, that the system employed for mounting side bars 15 should facilitate the easy coupling and uncoupling of frame 14 to the car, since frame 14 would not normally be employed during warm weather.

The front connecting member 16 is welded between the forward ends of side bars 15 generally below the car's front bumper 20. Again, this member is preferably constructed of steel. A pair of brackets 24, which in the illustrated embodiment comprise a pair of forwardly extending short plates 26, having axially aligned holes, are provided on front member 16 just inwardly of the corners of the car 12.

The second major component of the plow assembly is a plow blade support frame 30 which comprises a generally triangular frame consisting of a rear side member 31 and forwardly extending side members 32. Each component is preferably constructed of angle steel. Frame 30 also includes a pair of coupling plates 35 which are welded to frame 30 adjacent the rear corners thereof, plates 35 being arranged and adapted for being inserted between the brackets 24 of frame 14. The coupling plates 35 also include a hole therethrough so that quick disconnect pins 37 may be inserted through the three aligned holes to pivotally couple blade support frame 30 to frame 14. It will be appreciated then that the forward end of frame 30 is movable about a circular arc having an axis defined by pins 37.

A conventional plow blade 40 is pivotally connected to the forward end of support frame 30 so that the horizontal orientation of the blade may be adjusted relative to the axis of the vehicle and the means provided for controlling such horizontal orientation will be discussed in a later section of this specification. Blade 40 also includes a semi-circular swivel plate 42 welded to the back of the blade. The plate 42 includes a flat horizontal surface 43 and a vertical ridge 44 on the inner surface of the arc forming a track-like segment. A small triangular plate 45, is welded to the front of the support 30, the bottom of segment being slidably received thereon. A restraining bracket 46 is bolted to triangular plate 45 to prohibit vertical movement of swivel plate 42 with respect to plate 45, while permitting sliding movement of the horizontal surface 43 thereunder.

FIG. 1 also shows the snow plow assembly 10 to include a pair of springs 48 which permit the blade 40 to tip relative to the road surface if an obstruction is encountered. Springs 48 are connected between a pair of vertical supports 50 welded onto either side of swivel plate 42 and a pair of adjustable eyelets 51 secured generally near the top of blade 40 on the back side thereof. Eyelets 51 include threaded stems 52 and lock nuts to vary the length of springs 48 and in turn control the tension applied thereby. Eyelets 51 are secured to the upper portion of the blade 40 through a pair of brackets 54. From this description it should be understood that, if the bottom of plow blade 40 is obstructed during forward movement of the vehicle, the top of blade 40 will tip forwardly to allow the lower edge of the blade to pass over the obstruction.

Before proceeding with the description of the blade maneuvering system, it should be pointed out that other conventional equipment may be employed with the snow plow assembly 10. For example, adjustable skids (not shown) can be mounted to the blade support or the blade itself for displacing the blade by a preselected distance from the road surface. Likewise, any shape of plow blade may be employed, whether it be of the concave variety shown in the FIGURES or of the V-shaped design known the the art.

Referring again to FIG. 1, snow plow assembly 10 also includes a pair of hydraulic cylinders 60 and 61, for controlling the horizontal orientation of blade 40. Cylinders 60 and 61 each include an extensible piston rod 62 and 63 and hydraulic fluid hoses 64 and 65 respectively. The cylinders themselves are pivotally mounted to brackets 66 on the rear side 31 of blade support 30 and are spaced apart from one another but are relatively nearer the axis of the vehicle 12. The piston rods 62 and 63 are pivotally mounted to brackets 67 and the arcuate segment 42 intermediate the vertical supports 50 and the connections of segment 42 to the blade 40. In this manner, it can be seen that extension of piston rod 61 and corresponding retraction of the other pistion rod 62 will result in movement of the blade toward the right, and vice versa.

Figure 2:
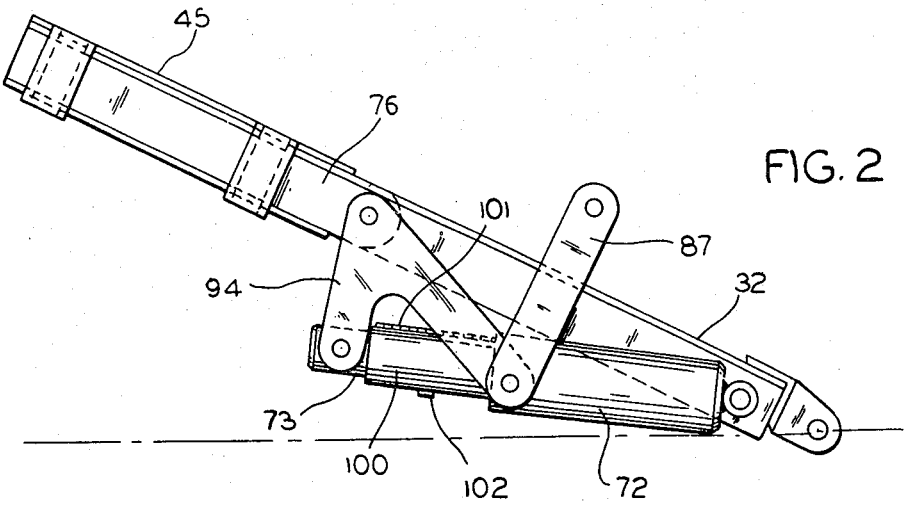
FIG. 2 is a detailed side view of the bell crank lifting system of the present invention.

By further reference to FIG. 1 and now by reference also to FIG. 2, the blade lifting mechanism of the present invention can be understood. A third hydraulic cylinder 72, having a piston rod 73, and fluid hose 74, is pivotally coupled to bracket 75 located at the middle of rear side 31 of blade support 30. In this position, piston rod 73 is oriented generally toward triangular plate 45. Another bracket 76 is mounted horizontally to the rear surface of plate 45, bracket 76 including a pair of parallel plates 77 having aligned holes (not shown). Yet another bracket 79 is provided behind the car's bumper (see the cut-away portion of FIG. 1), bracket 79 in turn being welded to an elongated steel lift bar member 81 which is ridigly secured to the front of car 12 on the vehicle's bumper bracket (not shown) or to the car's frame. Bracket 79 also includes a pair of parallel short plates 80 having aligned holes therein, but this bracket is directed generally downwardly and slightly forwardly.

A bell crank assembly 85 is mounted between brackets 76 and 79 and the end of piston rod 73 as will now be described. Assembly 85 includes a first generally Y-shaped link member 86 which includes symmetrical side plates 87 and 88. Plates 87 and 88 are welded to one another at the top of link 86 and fit between the plates 80 of bracket 79 and are pivotally secured thereto by pin 90. Side plates 87 and 88 diverge from one another below bumper 20 and then are bent so as to be parallel to one another. A hole (not shown) is provided at the lower end of each of plates 87 and 88.

A second link member 92 is also included in crank assembly 85. Link 92 also includes a pair of side members 94 and 95 each of which is generally L-shaped, the angle between the long and short portions of sides 94 and 95 actually being acute in the preferred embodiment. The long portions of sides 94 and 95 are pivotally mounted to bracket 76 (by pin 97) and to link 86 by a pin 98 passing through sides 87, 88, 94 and 95. The shorter portion of sides 94 and 95 are pivotally coupled between bracket 76 and the end of piston rod 73. It will then be apparent that extension of piston rod 73 will result in the lower end of link 92 being pushed forwardly under pin 97 causing the entire blade 40 and support 30 to be tilted upwardly. In FIG. 2, the cylinder 72, its poston rod 73, and the link members 86 and 92 are shown in the position they occupy when the blade is elevated.

The pistion rod locking means of the present invention is also shown in FIG. 2 to include a cylindrical sleeve 100 adapted to surround the extended piston rod 73. The sleeve 100 is split along its length and is hinged on one side by a hinge 101 while a latch 102 is provided on the other side. Locking sleeve 100 is used as follows: When the blade is elevated (FIG. 2) the locking sleve is opened and folded back about hinge 101. The sleeve is then placed around the piston rod 73 and locked into place by latch 102. When the sleeve is secured in place, the piston rod cannot be retracted, even if a failure occurs in the hydraulic fluid system.

Figure 3:
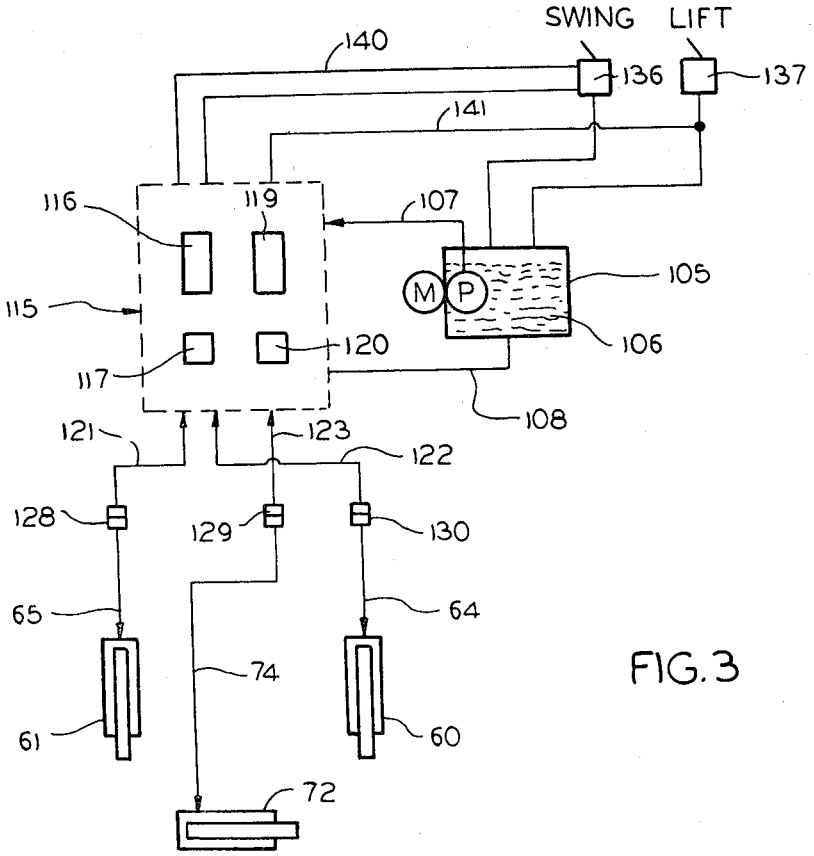
FIG. 3 is a schematic of the hydraulic system of the present invention.

FIG. 3 shows in schematic form the hydraulic and cylinder control system of the present invention. The placement of the operating components in the vehicle is not critical to the present invention, but it is preferred that the reservoir pump and valve components now to be described be mounted under the hood of the car 12 in its engine compartment, on the swivel plate 42 or on the cross member 16 of the subframe assembly.

The hydraulic system includes a tank 105 of hydraulic fluid 106 having inlet and outlet hoses 107 and 108 respectively. A pump P driven by an electric motor M powered by the car's electrical system is coupled to hoses 107 and 108 for supplying and receiving hydraulic fluid from a manifold valve assembly 115.

Valve assembly 115 in turn includes a directional control valve 116 and cross-over relief valve 117 for regulating the horizontal swing of blade 40 and a directional control valve 119 and lock valve 120 for control of the lift system. Hoses 121 and 122 leave the valve assembly swing components and are coupled respectively to hoses 65 and 64 while another fluid hose 123 from the valve lift components is coupled to hose 74. Quick disconnect couplings 128-130 are provided for allowing rapid coupling and uncoupling of the respective hoses between those in the car's engine compartment and those mounted to plow assembly 10 when the hydraulic components are in the engine compartment. See FIG. 1.

Toggle switches 136 and 137 are also included in the system, the toggle switches being mounted on the dash board of the car or at some other interior location where they are readily accessible to the driver. Switch 136 is coupled to the valve swing components by wires 140 and controls the flow of fluid to and from cylinders 60 and 61, while switch 137 is connected to the valve lift components by wires 141 and controls the flow of fluid to cylinder 72.

Figure 4:
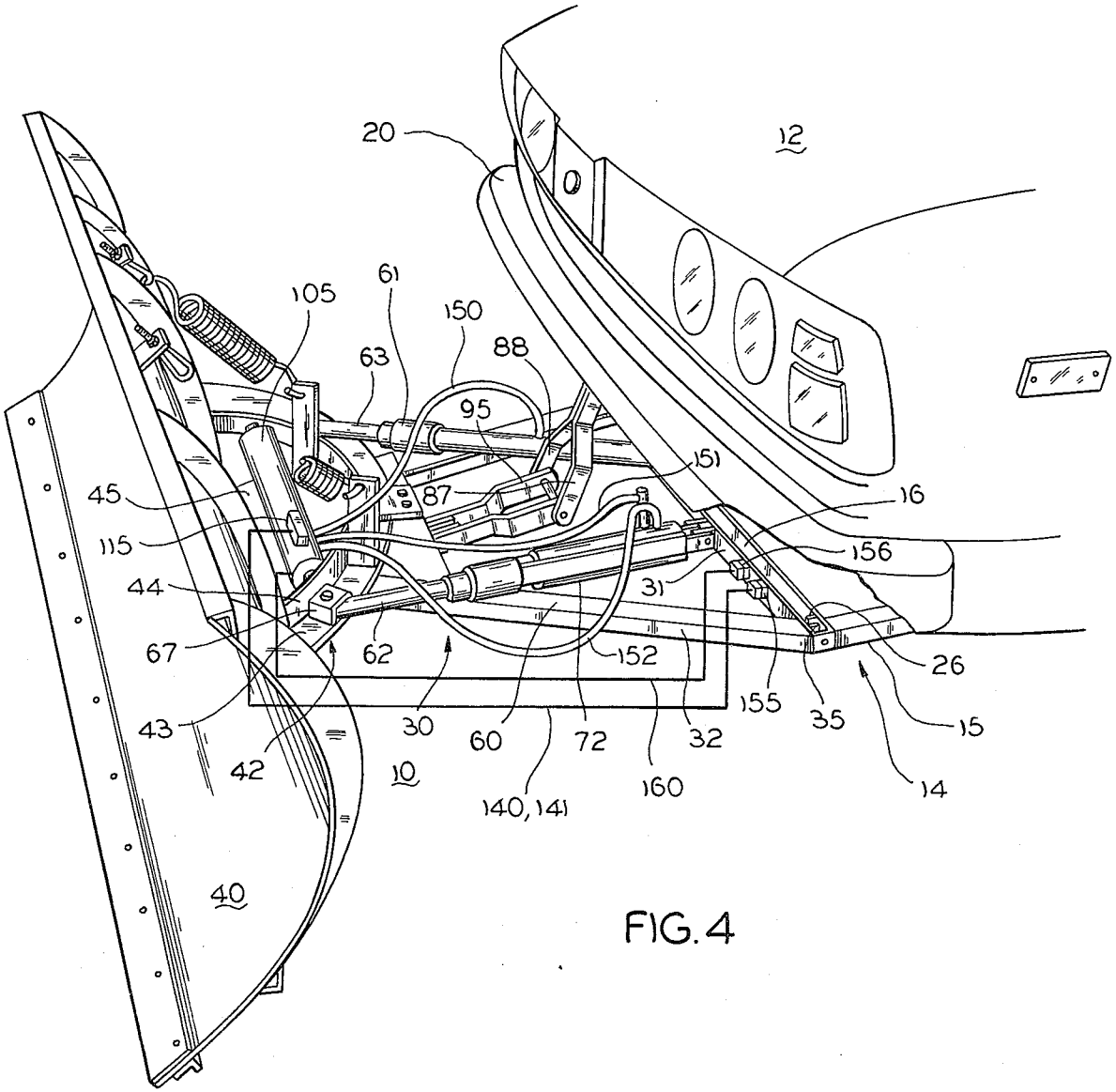
FIG. 4 is a partial perspective view, with parts omitted, of the snow plow assembly shown in FIG. 1 in which the hydraulic components are mounted to the plow support assembly.

FIG. 4 shows a second embodiment in which the hydraulic components 105 and the valve assembly 115 are mounted on the swivel plate 42 instead of in the engine compartment. In this embodiment hoses 121 and hose 65 are replaced by a single hose 150; hoses 123 and 74 are replaced by a single hose 151, and hoses 122 and 64 are replaced by a single hose 152. In addition, the quick disconnects 128 and 130 are eliminated. In lieu thereof a quick disconnect 155 is provided for wires 140 and 141 and a further quick disconnect 156 is provided for the power supply electrical cable 160 coupled to the hydraulic pump and motor and to the car's electrical system.

The system shown in FIG. 4 has several advantages over the system shown in FIGS. 1 and 3. First, the manufacturing cost is smaller because the length of hydraulic hose is substantially less and the two electrical disconnects are considerably less expensive than the hydraulic disconnects. Secondly, the installation time for the completed assembly is substantially less because the hydraulic components and hoses do not have to be mounted in the vehicle. The only installation required will be the attachment of the subframe assembly, the placement of the switches 136 and 137 and running two electrical cables to the bumper area of the car. Third, the system shown in FIG. 4 is preferred for those automobiles which do not have sufficient room in the engine compartment. Fourth, the vehicle's weight is lighter during periods when the plow is not attached, thus reducing any negative fuel economy resulting from the use of the plow of the present invention. Fifth, the relatively expensive hydraulic components can be safely stored when the plow is not in use, thus avoiding problems with vandalism and unnecessary exposure to the elements when the plow is not needed.

Figure 5:
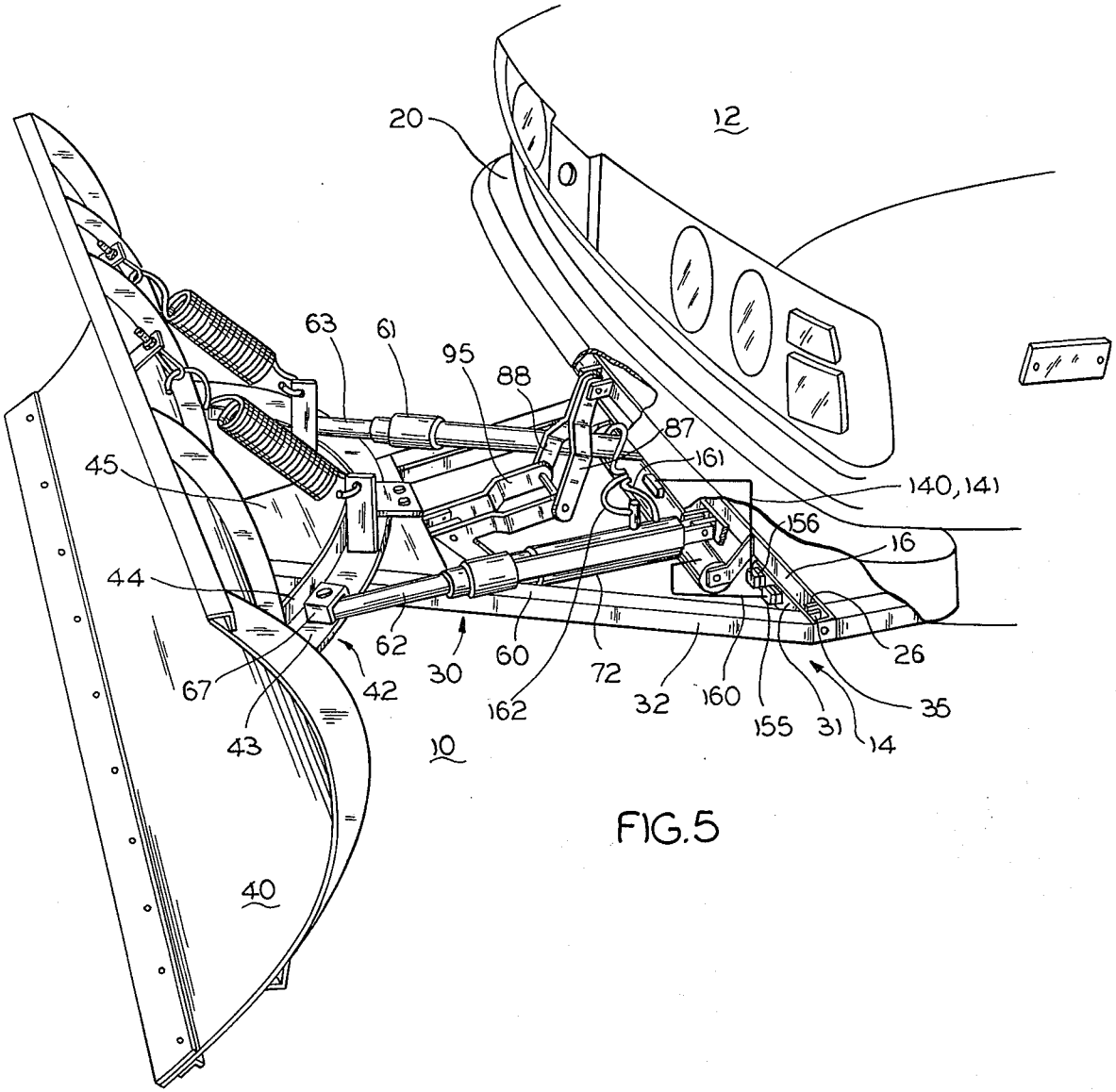
FIG. 5 is a partial perspective view, with parts omitted, of the snow plow assembly shown in FIG. 1 in which the hydraulic components are mounted to the vehicle subframe assembly.

FIG. 5 shows another alternate embodiment of the present invention in which the hydraulic and valve components 105 and 115 are mounted to the cross bar 16 of the vehicle subframe assembly. In this embodiment hoses 121 and 65 of FIG. 1 are replaced by a single short hose 160; hoses 123 and 74 (FIG. 1) are replaced by a single short hose 161; and hoses 122 and 64 are replaced by a single short hose 162. In addition, the disconnects of FIG. 1 are again replaced by the electrical disconnects 155 and 156 which are for the same services as described in FIG. 4.

The system shown in FIG. 4 has many of the advantages shown in FIG. 5 but has the added advantage of reduced hose length and use for some vehicles where mounting on the plow may be impractical.

Now that the major components of the present invention have been described, its operation will be explained. When cold weather approaches, frame 14 is bolted to the chassis of car 12. It is assumed that the hydraulic components have been mounted on the car or the plow or the subframe assembly and that switches 136 and 137 have beeen installed on the car's dash board and the necessary hydraulic or electrical disconnects have been installed.

When it is desired to use the plow assembly 10 it is connected to the car by merely inserting pins 37 in the two brackets coupling frame 14 to blade support frame 30 and by inserting an additional pin 80 in bracket 79 so that the link member 86 is secured behind bumper 20. The hoses or wires (again depending on which embodiment is used) are then coupled to the disconnects to complete the mounting of assembly 10.

It will be apparent from the foregoing description that toggle switch 137 can be moved by the driver to control the elevation of blade 40 and that toggle switch 136 can be selectively moved to change the horizontal orientation or swing of blade 40.

While the present invention has been described in connection with a single preferred embodiment, it is not to be limited by such description but is to be limited solely by the claims which follow. For example, while the invention has been described in connection with a snow plow, the lift system of the present invention is adaptable for use with bulldozer blades, or other similar types of implements.

I claim:

1. A snow plow assembly suitable for use with a wheeled vehicle comprising:

a plow support frame adapted for being coupled to a wheeled vehicle, said support frame including an arcuate segment and first cylinder means and second cylinder means for adjusting the horizontal angular orientation of a plow blade;

a plow blade coupled to said plow support frame and to said horizontal angular adjustment means;

vertical adjustment means coupled between the front of said vehicle and a forward portion of said plow support frame to permit vertical adjustment of said plow blade, said vertical adjustment means including a bell crank means and third cylinder means mounted to said plow support frame and having piston rod means coupled to said bell crank means;

a hydraulic system including hydraulic fluid reservoir, pump and valve means mounted to said arcuate segment and coupled by hose means to said horizontal angular adjustment means and to said vertical adjustment means; control means coupling said vehicle and said hydraulic system for actuating said horizontal angular adjustment means and said vertical adjustment means from the vehicle cab;

said plow support frame further includes a generally triangular frame having first, second and third sides, said first side being pivotally coupled to said vehicle whereby the plow support frame is vertically rotatable with respect to said first side, said plow blade being mounted to the corner of said plow support frame between said second and third sides, each of said cylinder means being pivotally mounted to said first side with said third cylinder means being intermediate said first and second cylinder means;

said snow plow assembly further includes a vehicle subframe rigidly coupled to the underside of said vehicle and including a front member extending across and beneath the front of said vehicle, a pair of spaced apart brackets being located on said front member and having axially aligned holes passing therethrough, said first side of said plow support frame including a pair of bracket plates adapted for being coupled to said spaced apart brackets by pin means;

said plow support frame further includes a bell crank receiving bracket at an area thereof generally adjacent said plow blade;

said bell crank means includes a first generally Y-shaped link member the base of which is pivotally coupled to the front of said vehicle and a second generally L-shaped link member having first and second sides, the end of said first side of said L-shaped link member being coupled between the free ends of said first link member and the end of said second side of said L-shaped link member being pivotally coupled to said piston rod of said first cylinder, the angular corner of said L-shaped link member being pivotally coupled to said bell crank receiving bracket.

* * * * *